United States Patent [19]

Bush et al.

[11] Patent Number: 4,699,020

[45] Date of Patent: Oct. 13, 1987

[54] HANDLE ADAPTER

[75] Inventors: Eugenia Bush, Decatur; Frank Wilson, Trinity; Mark Woyak, Decatur, all of Ala.

[73] Assignee: Champion International Corporation, Stamford, Conn.

[21] Appl. No.: 865,641

[22] Filed: May 15, 1986

Related U.S. Application Data

[63] Continuation of Ser. No. 641,282, Aug. 16, 1984, abandoned.

[51] Int. Cl.[4] ..... B25B 13/00; B25G 1/00; B25G 1/12; G05G 1/00

[52] U.S. Cl. ..... 74/544; 81/177.2

[58] Field of Search ..... 74/543–546; 81/177.2, 177.5, 177.6, 436; 173/163

[56] References Cited

U.S. PATENT DOCUMENTS

| | | | |
|---|---|---|---|
| 583,910 | 6/1897 | Knapp | 81/177.5 |
| 921,840 | 5/1909 | Jacobs | 81/177.2 |
| 1,594,081 | 7/1926 | Van Duzer | 81/177.6 |
| 1,744,413 | 1/1930 | Peterson et al. | 81/177.1 |
| 2,899,839 | 8/1959 | Zelnick | 74/545 |
| 2,943,837 | 7/1960 | Noble | 74/544 |
| 3,113,479 | 12/1963 | Swingle | 81/177.2 |
| 3,161,093 | 12/1964 | Hoag | 81/177.6 |
| 3,175,436 | 3/1965 | Coleman | 74/544 |
| 3,227,015 | 1/1966 | Tremblay | 81/177.2 |
| 3,276,299 | 10/1966 | Halburian | 81/177.5 |
| 3,515,125 | 6/1970 | Ruskin | 81/177.2 |
| 3,592,086 | 7/1971 | Derwin | 81/177.2 |
| 3,813,182 | 5/1974 | Brach | 81/177.5 |
| 4,387,483 | 6/1983 | Larrabee | 173/163 |
| 4,566,357 | 1/1986 | Carossino | 81/177.2 |

FOREIGN PATENT DOCUMENTS

| | | | |
|---|---|---|---|
| 857325 | 10/1952 | Fed. Rep. of Germany | 81/177.2 |
| 2453480 | 5/1976 | Fed. Rep. of Germany | 81/177.2 |
| 2823464 | 12/1979 | Fed. Rep. of Germany | 81/177.2 |

*Primary Examiner*—Gary L. Smith
*Assistant Examiner*—Vinh Luong
*Attorney, Agent, or Firm*—Evelyn M. Sommer

[57] ABSTRACT

A packing hood handle adapter for providing an increased manual torque producing leverage to an elongated tool stem. The handle adapter includes an elongated body for providing the increased torque. The diameter or thickness of the elongated body is provided such that it can include an interior chamber defined by the body side wall which is large enough to receive the oppositely extending transverse handle or cross-member of the "T-shaped" handle. A longitudinal opening in the body side wall is in communication with the interior chamber and is wider and longer than the T-shaped handle to permit the cross-member to move into and out of the interior chamber. A transverse opening is provided to accomodate and seat the stem when the cross-member or oppositely extending transverse handle is in the interior chamber. The transverse opening is intermediate the ends of both the interior chamber and the longitudinal member, and in the case of the standard packing hook handle adapter, is at right angles thereto. The transverse opening can be a cylindrical hole or a semi-cylindrical slot or other channel.

1 Claim, 9 Drawing Figures

HANDLE ADAPTER

This application is a continuation of application Ser. No. 641,282, filed Aug. 16, 1984, now abandoned.

BACKGROUND OF THE INVENTION

Torquing tools of the type which include an elongated tool stem having an oppositely extending transverse handle on one end and a work engaging portion on the other are used for various mechanical operations. An example is the use of such a tool for the removal of packings or gaskets from large fluid conductor joints in pulp and paper mill equipment. Such a tool is called a "packing hook" and has a stem, a handle forming a "T-shape" at one end of the stem and a hook of typical corkscrew shape at the opposite end of the stem. The stem may be a solid rod or may have some flexibility but must be capable of torque transmission and may take the form of a braided steel cable of appropriate length.

The work engaging end or "corkscrew" of the torquing tool is advanced into the soft packing material by applying manual torque producing leverage through the handle. The handle then is pulled by means of manual or otherwise applied tensile force to pull the packing from its seat in sealing engagement between two metal fluid conductor parts which define a joint in the fluid conductor or machinery. Often, a conventional "come-along" to increase the mechanical advantage is used during the packing removal operation by means of a cable attachment.

BRIEF DESCRIPTION OF THE INVENTION

The handle adapter of the present invention is a simple and inexpensive device which is handy for making operations such as packing removal simpler and safer. The adapter is removable from the tool handle for storage and so that it does not limit turning of the tool in close or tight areas of use.

The invention basically simplifies the use of a torquing tool by providing a hand grip of larger diameter, and therefore of increased comfort to the operator's hand, and a hand grip of greater length, and therefore of increased torque leverage.

The handle adapter of the invention includes an elongated body for providing the increased torque. The diameter or thickness of the elongated body is provided such that it can include an interior chamber defined by the body side wall which is large enough to receive the oppositely extending transverse handle or cross-member of the "T-shaped" handle. A longitudinal opening in the body side wall is in communication with the interior chamber and is wider and longer than the "T-shaped" handle to permit the cross-member to move into and out of the interior chamber. A transverse opening is provided to accomodate and seat the stem when the cross-member or oppositely extending transverse handle is in the interior chamber. The transverse opening is intermediate the ends of both the interior chamber and the longitudinal member, and in the case of a standard packing hook handle adapter, is at right angles thereto.

The transverse opening can be a cylindrical hole or a semi-cylindrical slot or other channel. The leverage is more easily applied in the case of a cylindrical hole and it is preferred. However, in certain applications it is not convenient to have to slip the packing hook, or other work engaging tool end, as the case may be, through the transverse opening. The semi-cylindrical slot or other channel can then be provided as the transverse opening and the tool end will not have to pass through it.

The adapter of the invention is conveniently made from a length of pipe or tubing with the hollow interior acting as the interior chamber and the longitudinal opening being a longitudinal slot through the side wall just wide enough for the cross-member of the handle. The ends may or may not be plugged, as desired. The transverse opening may be drilled, or if open sided, milled. Suitable chamfers are provided at appropriate surface junctures. An alternative is to cut and drill the adapter from bar stock or a solid rod. In any event, no special stock, molds, tools or assembly are required to produce the adapter of the invention. Its simplicity of manufacture is in contrast to the Allen key grip of the West German Offenlegungschrift No. DT2453480 Al or the measuring tape handle extending apparatus of U.S. Pat. No. 2,899,839, as only simple stock and operations are required.

BRIEF DESCRIPTION OF THE DRAWINGS

Like numerals are used to designate like parts in the various views of the drawings.

DESCRIPTION OF THE ILLUSTRATED EMBODIMENTS

Figure 3:
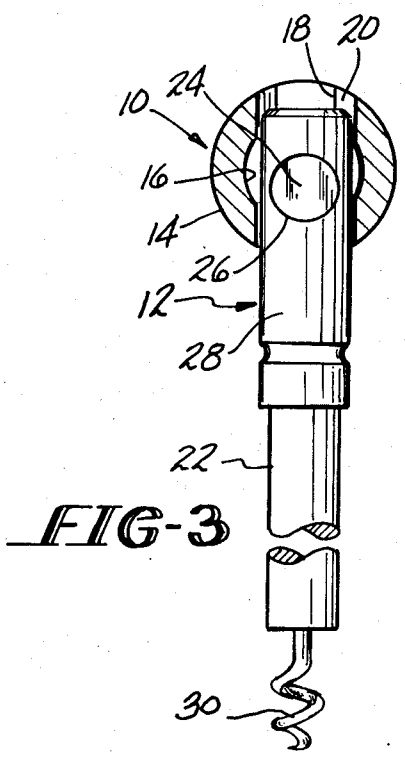
FIG. 3 is a cross-sectional view of the adapter of FIGS. 1 and 2 taken along the line 3—3 of FIG. 1 with the packing hook shown in full.
Figure 1:
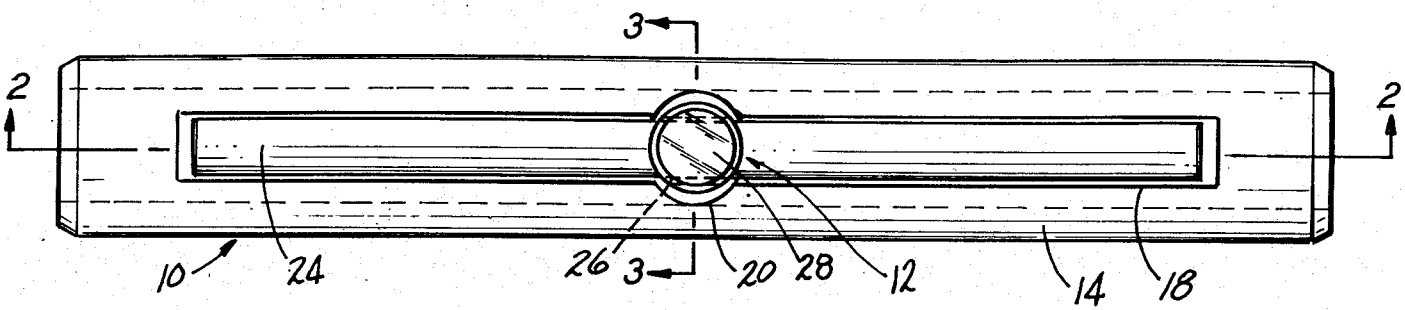
FIG. 1 is a top plan view of the handle adapter of the invention attached to a packing hook.
Figure 2:
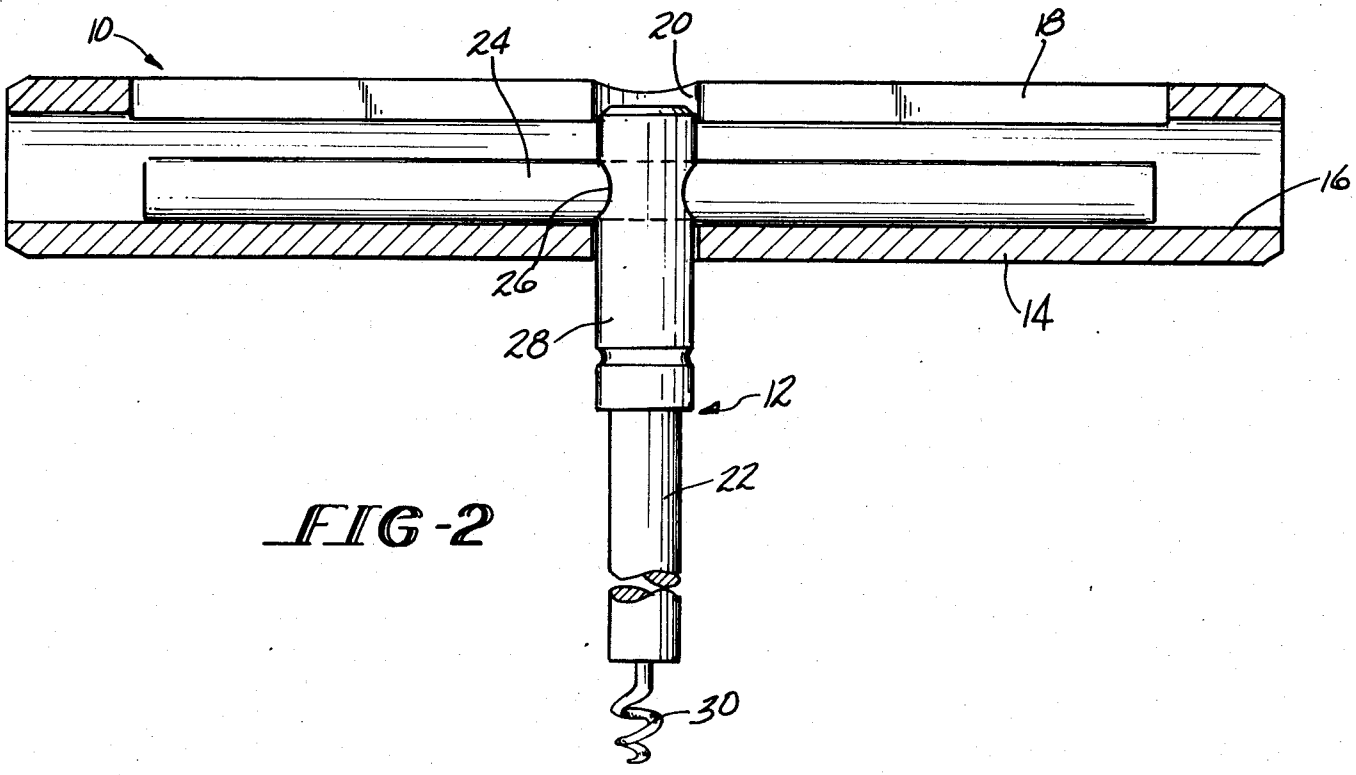
FIG. 2 is a cross-sectional view of the adapter of FIG. 1 taken along the line 2—2 of FIG. 1 with the packing hook shown in full.
Figure 6:
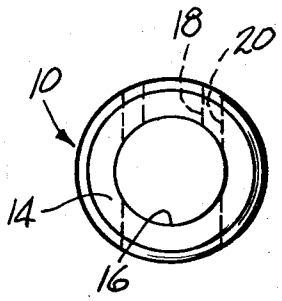
FIG. 6 is an end view of the handle adapter of FIGS. 1—5.
Figure 4:
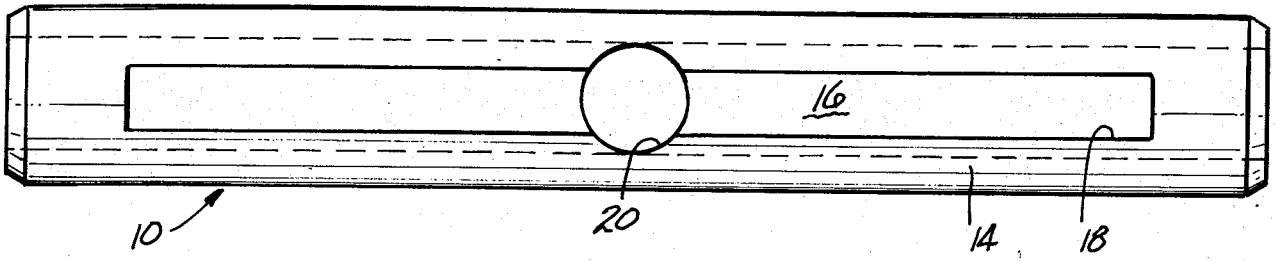
FIG. 4 is a top plan view of the handle adapter of FIGS. 1—3.
Figure 5:
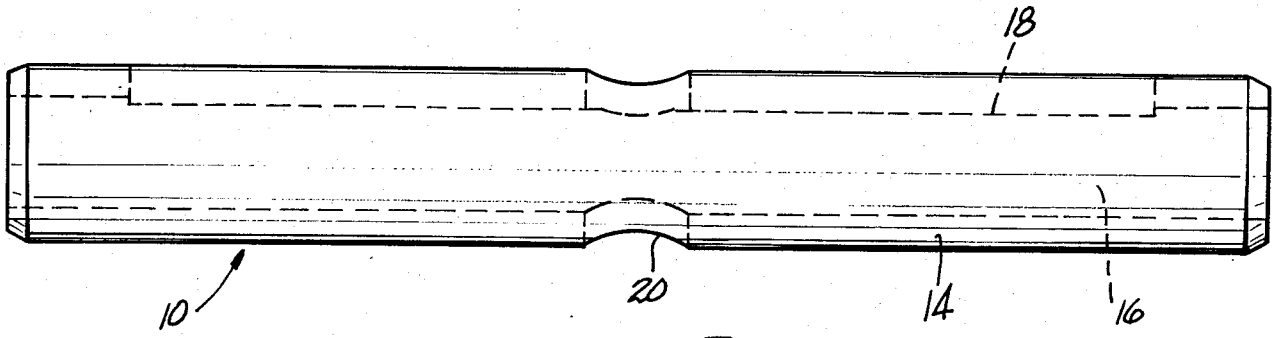
FIG. 5 is a side elevation view of the handle adapter of FIGS. 1—4.

The numeral 10 generally designates the handle adapter of the invention. The numeral 12 generally designates a torquing tool in the form of a packing hook 12 with which adapter 10 is used to increase torque leverage and hand comfort.

The adapter 10 has an elongated hollow body defined by a side wall 14 of a length of pipe or tubing. The side wall 14 defines an interior chamber 16. A longitudinal opening 18 in said body side wall is cut, as by milling, so as to be in communication with the interior chamber 16, but of lesser length. A transverse opening 20 is drilled or otherwise provided in communication with both the interior chamber 16 and the longitudinal opening 18 intermediate the ends of both to permit the tool stem 22 to be received in the transverse opening 20 and the oppositely extending transverse handle or "T-shaped" cross-member 24 to be received in the longitudinal opening 18 and interior chamber 16.

The cross-member 24 extends through an opening 26 in a stem end or cap portion 28 secured on the end of the stem 22. In the embodiment illustrated in FIGS. 1—9, the work engaging end 30, of the packing hook 12 is of "corkscrew" shape and passes through transverse opening 18, as does the packing hook stem 22, until cross-member 24 seats against the tube wall 14 in the bottom of interior chamber 16.

The handle adapter 10 mounted on packing hook 12, in this manner, provides a manual grip on the outside of the side wall 14 which is comfortable for applying tensile force because of its increased diameter over that of cross-member 24, and which provides increased torquing leverage because of its increased length over that of cross-member 24.

Figure 9:
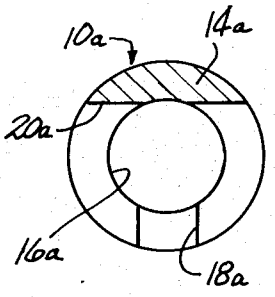
FIG. 9 is a cross-secticnal view of the handle adapter of FIGS. 7 and 8 taken along the line 9—9 of FIG. 7.
Figure 7:
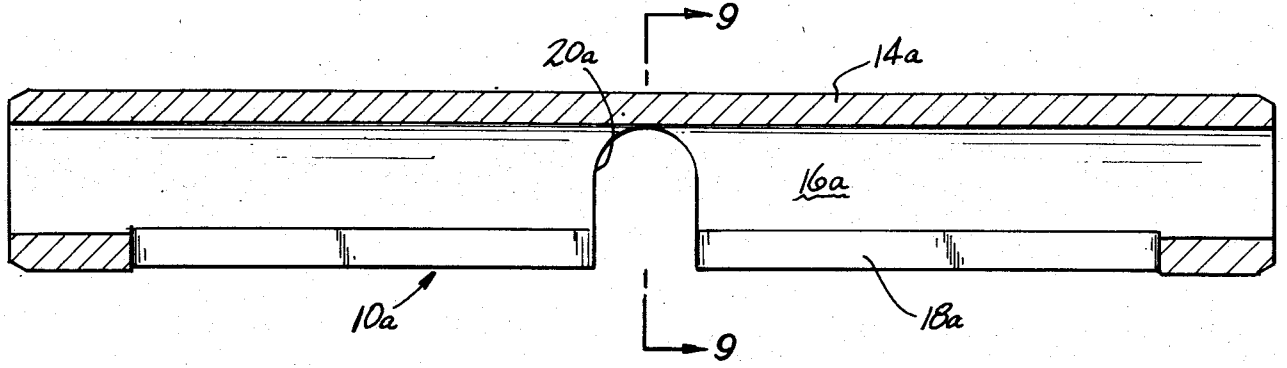
FIG. 7 is a cross-sectional view of a second embodiment of the handle adapter of the invention taken along the line 7—7 of FIG. 8.
Figure 8:
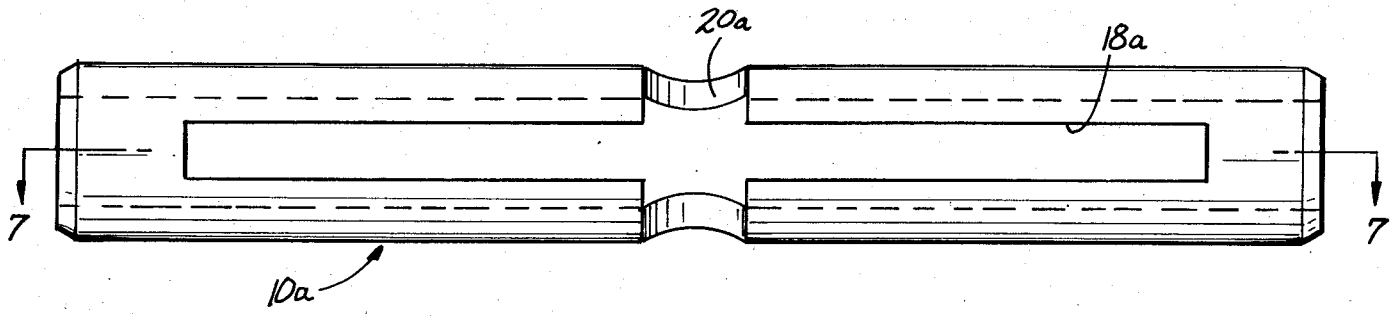
FIG. 8 is a side elevation view of the handle adapter of FIG. 7.

The adapter embodiment 10*a* illustrated in FIGS. 7–9 has its transverse opening 20*a* of channel or semi-circular shape and its longitudinal opening 18*a* at 90° from the channel center line. For this reason, in close working places, or if the work engaging end 30*a* (not shown) of the torquing tool is larger than the stem or stem cap, the adapter may be mounted and removed without passing the end through the transverse opening. In this embodiment care to ensure that cross-member 24*a* (not shown) is seated in the bottom of interior chamber 16*a* is required for torquing leverage.

Thus it will be seen that a handle adapter for torquing tools such as packing hooks has been provided which affords inexpensive manufacture and comfortable and improved use.

What is claimed is:

1. In combination with a tool having an elongated stem portion and a tee-shaped handle mounted at one end of said stem portion, an adapter for providing increased torquing and pulling leverage to the tool, said adapter comprising an elongated tubular body having an axial through passage bounded by an annular side wall, a longitudinal opening formed in said body side wall, said longitudinal opening being sized so as to allow passage of the tool handle through said longitudinal opening into said through passage, and a transverse opening extending into said body side wall from two opposite sides of said longitudinal opening, said transverse opening being disposed on said adaptor and extending a sufficient transverse distance into said adaptor to pass through said longitudinal opening and into said through passage, said transverse opening being sized to allow entry of the tool stem portion into said transverse opening when the tool handle is disposed in said through passage.

* * * * *